US012753546B2

(12) United States Patent
Yan

(10) Patent No.: US 12,753,546 B2
(45) Date of Patent: Oct. 6, 2026

(54) STEAM IRONING HEAD, HAND-HELD IRONING MACHINE AND GARMENT STEAMER

(71) Applicant: NINGBO KAIBO GROUP CO., LTD., Ningbo (CN)

(72) Inventor: Jie bo Yan, Ningbo (CN)

(73) Assignee: NINGBO KAIBO GROUP CO., LTD., Ningbo (CN)

( * ) Notice: Subject to any disclaimer, the term of this patent is extended or adjusted under 35 U.S.C. 154(b) by 0 days.

(21) Appl. No.: 18/811,216

(22) Filed: Aug. 21, 2024

(65) Prior Publication Data

US 2025/0389077 A1 Dec. 25, 2025

(30) Foreign Application Priority Data

Jun. 21, 2024 (CN) ..... 202410806055.5

(51) Int. Cl.
*D06F 75/20* (2006.01)

(52) U.S. Cl.
CPC ..... *D06F 75/20* (2013.01)

(58) Field of Classification Search
CPC ..... D06F 75/10; D06F 75/20; D06F 73/00; D06F 87/00
See application file for complete search history.

(56) References Cited

U.S. PATENT DOCUMENTS 2,362,590 A * 11/1944 Smith ..... D06F 75/08 34/91
3,716,933 A * 2/1973 Evans ..... D06F 75/10 38/75
3,824,719 A * 7/1974 Miranker ..... D06F 75/00 38/77.3
2013/0219758 A1* 8/2013 Jiang ..... D06F 73/00 68/222
2017/0321371 A1* 11/2017 Kuan ..... D06F 81/08
2020/0071874 A1* 3/2020 Javit ..... D06F 75/20

FOREIGN PATENT DOCUMENTS

| | | | |
|---|---|---|---|
| CN | 1496430 | A | 5/2004 |
| CN | 102535134 | B | 7/2016 |
| CN | 113186698 | A | 7/2021 |
| EP | 2455540 | A1 | 5/2012 |
| WO | WO2013057651 | A1 | 4/2013 |
| WO | WO2013164275 | A1 | 11/2013 |

* cited by examiner

*Primary Examiner* — Nathan E Durham
(74) *Attorney, Agent, or Firm* — MUNCY, GEISSLER, OLDS & LOWE, P.C.

(57) ABSTRACT

A steam ironing head, a hand-held ironing machine and a garment steamer. An ironing surface is equipped with a blowing device featuring a blowing port and a flow guiding surface. The orientation of the blowing port deviates from the normal direction of the ironing surface, so that when the ironing surface is close to clothing, the airflow blown out from the blowing port pushes the clothing toward the flow guiding surface, and an airflow channel is maintained between the clothing and the flow guiding surface. During ironing, the airflow blown by the blowing device flows between the clothing and the flow guiding surface, forming a low pressure between the clothing and the flow guiding surface, pulling the clothing toward the flow guiding surface, and making the clothing close to the ironing surface. The invention has a consistent attraction effect and good versatility.

12 Claims, 7 Drawing Sheets

STEAM IRONING HEAD, HAND-HELD IRONING MACHINE AND GARMENT STEAMER

BACKGROUND OF THE INVENTION

1. Technical Field

The invention belongs to the technical field of clothing ironing, and particularly relates to a steam ironing head, a hand-held ironing machine and a garment steamer.

2. Description of Related Art

The Chinese invention patent application with public number CN1496430A discloses a household manual iron designed for use without an ironing board, featuring an iron bottom plate with suction holes and a fan driven by a motor. In operation, textiles can be held on the iron bottom plate with the assistance of the suction force generated by the airflow passing through the suction holes.

The Chinese invention patent CN102535134B discloses a steaming head for a garment steamer. The steaming head comprises a main body with a front end, an air inlet formed in the front end, and steam outlets. Suction is applied to draw air through the air inlet, causing clothing fabric near the front end to be drawn toward the front end. During use, steam is applied to the clothing fabric through the steam outlets. The front end of the main body comprises a first surface and a second surface, the steam outlets are formed in the first surface, the air inlet is formed in the second surface, causing the fabric to be sucked toward the second surface, and steam is applied to the fabric at the first surface. The first surface and the second surface form a convex surface together.

For the iron and steaming head described in the aforementioned patent literature, the iron bottom plate with the suction holes and the second surface with the air inlet are referred to as adsorption surface, the suction hole and the air inlet are collectively referred to as suction port, and the textiles and the clothing fabric are collectively referred to as clothing. When in use, the clothing is held on the adsorption surface by suction, causing the clothing to come into contact with the adsorption surface and cover the suction port during ironing. Due to differences in material, structure, and manufacturing processes, there are differences in the softness and breathability of clothing, leading to variations in the degree of deformation and airflow permeability of different materials during ironing. For example, clothing with good softness is easily attracted by suction to adhere to the adsorption surface, achieving a good adsorption effect. However, soft and delicate clothing may be at risk of deformation and damage when exposed to strong suction. Clothing with poor softness is not easily attracted by suction to adhere to the adsorption surface, making it difficult to achieve a good adsorption effect. Clothing with good breathability, when adhering to the adsorption surface under suction, enables the return airflow at the suction port to be maintained even if it blocks the suction port, making it easy for the adsorption surface to move relative to the clothing to facilitate continuous ironing. The attraction of the suction force to the clothing is continuous. In contrast, clothing with poor breathability, when adhering to the adsorption surface under suction, almost completely blocks the suction port, making it difficult to maintain the return airflow at the suction port and causing difficulty in the movement of the adsorption surface relative to the clothing, thus hindering continuous ironing. Furthermore, the complete blockage of the suction port can result in increased noise from the fan.

As previously mentioned, clothing adhering to the adsorption surface under suction through the suction port during ironing can result in poor versatility of the iron and the steaming head, potentially causing damage to clothing and affecting user experience.

BRIEF SUMMARY OF THE INVENTION

The technical problem to be solved and the technical task to be proposed by the invention are to overcome the defects of the prior art that clothing adhering to an adsorption surface under suction through a suction port during ironing can result in poor versatility of an iron and a steaming head, potentially causing damage to clothing and affecting user experience. The invention provides a steam ironing head, a hand-held ironing machine and a garment steamer, which are used for improving the universality of products, reducing the risk of damaging clothing and improving the ironing experience of users.

To achieve the above objectives, the steam ironing head provided by the invention comprises an ironing surface with steam release holes, wherein the ironing surface is provided with a blowing device, the blowing device is provided with a blowing port and a flow guiding surface, and the orientation of the blowing port deviates from the normal direction of the ironing surface, causing the airflow blown out from the blowing port when the ironing surface is close to clothing to push the clothing toward the flow guiding surface, and maintaining an airflow channel between the clothing and the flow guiding surface.

In this way, during ironing, the airflow passes between the clothing and the flow guiding surface, creating a low pressure between the clothing and the flow guiding surface based on the Bernoulli principle. This low pressure pulls the clothing toward the flow guiding surface, ensuring that the clothing stays close to the ironing surface. Additionally, maintaining the airflow channel between the clothing and the flow guiding surface prevents the clothing from adhering to the flow guiding surface, leading to a consistent attraction effect for clothing with differences in softness and breathability, always keeping the clothing close to the ironing surface, and realizing good product versatility. Moreover, since the clothing does not adhere to the flow guiding surface, the risk of clothing damage during ironing is reduced. By maintaining the airflow channel between the clothing and the flow guiding surface during ironing, the blowing device provides continuous and stable airflow, blockage of the blowing port is avoided, and the working noise of the blowing device is kept at a low level without sudden increases, thus enhancing the user experience.

Preferably, an included angle ranging from −30° to 30° is maintained between the orientation of the blowing port and the tangential direction of the ironing surface. This allows the airflow to flow along surfaces of the clothing and the flow guiding surface, ensuring that a low pressure is formed between the clothing and the flow guiding surface to prevent the clothing from being blown off the flow guiding surface and the ironing surface.

Preferably, the blowing port is located at a rear side of an edge of the ironing surface. This enables the clothing to be positioned as close to the ironing surface as possible, ensuring that the steam released from the steam release holes can be applied to the clothing at a higher temperature and a higher velocity, thus achieving a good ironing effect.

Preferably, the flow guiding surface is a curved surface and protrudes forward. This contributes to the formation of a low pressure between the clothing and the flow guiding surface through the "Coanda effect", allowing the clothing to be positioned as close to the ironing surface as possible, ensuring that the steam released from the steam release holes can be applied to the clothing at a higher temperature and a higher velocity, thus achieving a good ironing effect.

Preferably, the flow guiding surface extends from a rear edge of the blowing port in a direction away from an air outlet. This gives the flow guiding surface an appropriate length and area so that when the ironing surface is brought close to the clothing, a low pressure can be quickly formed between the clothing and the flow guiding surface, achieving the attraction effect.

Preferably, a confluence area is formed at an outlet of the blowing port between the flow guiding surface and the tangential direction of the ironing surface, and the confluence area gradually decreases as it extends away from the blowing port. This can increase the airflow speed, effectively pulling the clothing toward the flow guiding surface.

Preferably, the flow guiding surface is entirely located at a rear side of the tangential direction of the ironing surface. This enables the clothing to be positioned as close to the ironing surface as possible, ensuring that the steam released from the steam release holes can be applied to the clothing at a higher temperature and a higher velocity, thus achieving a good ironing effect. In addition, when users lay clothing flat on an ironing board for ironing, it ensures that the ironing surface makes contact with the clothing.

Preferably, the blowing port and the flow guiding surface are located at a lower side of the ironing surface. This facilitates user operations. For example, when ironing clothing which is in a hung state, the ironing surface is moved downward along the surface of the clothing, and by means of the pulling force of hangers and the low pressure generated by airflow which attracts the clothing toward the ironing surface, the part of the clothing corresponding to the ironing surface can maintain tension and flatten, which is conducive to the application of released steam onto the clothing, resulting in a good ironing effect.

Preferably, the blowing device is equipped with air inlets, and the air inlets avoid the blowing port and the flow guiding surface. This can maintain the stable operation of the blowing device, resulting in minimal noise, and also prevent the low pressure formed by the airflow from becoming unstable or weakening due to the air inlets being positioned too close to the blowing port and the flow guiding surface.

Preferably, the blowing device operates using power from a power cord or from a storage battery. This provides a variety of implementation schemes for the product structure.

Preferably, the ironing surface is arranged on a head housing, the blowing device is located in the head housing, and a blowing channel connecting the blowing port with the blowing device is arranged inside the head housing. This helps to form a stable and reliable product structure and ensure the realization of product functions.

Preferably, the ironing surface is arranged on a head housing, and the blowing device or/and the flow guiding surface are detachably attached to the head housing. When the attraction function is not needed, for example, when the user irons clothing laid flat on the ironing board, the blowing device or/and the flow guiding surface can be detached from the head housing, thus reducing the holding burden of the user during ironing.

Preferably, the blowing port is slit-shaped and extends in a length direction of one straight edge of the ironing surface. This ensures consistent blowing intensity at various parts of the blowing port, so that when moving in a direction perpendicular to the straight edge of the ironing surface, all parts of the blowing port achieve a consistent attraction effect on the clothing.

Preferably, to realize a better fit between the ironing surface and the clothing, the widths of the blowing port, the flow guiding surface and the ironing surface tend to be consistent. In this way, clothing can be attracted within the whole width range of the ironing surface, and the whole area of the ironing surface can be used to iron clothing.

The steam ironing head provided by the invention can be applied to a hand-held ironing machine, which comprises a water tank, a water pump and a steam generator, the water pump is used for conveying water stored in the water tank to the steam generator, and the steam generator is used for vaporizing the conveyed water into steam. The hand-held ironing machine further comprises the steam ironing head provided by the invention, the steam generated by the steam generator is released from the steam release holes, and the steam ironing head, the water tank, the water pump and the steam generator are assembled into a whole for holding and ironing.

The steam ironing head provided by the invention can be applied to a garment steamer, which comprises a main body equipped with a water tank, a water pump and a steam generator, the water pump is used for conveying water stored in the water tank to the steam generator, and the steam generator is used for vaporizing the conveyed water into steam. The garment steamer further comprises the steam ironing head provided by the invention, the steam ironing head is connected with the steam generator through a steam pipe, and the steam generated by the steam generator is conveyed to the steam ironing head through the steam pipe and released from the steam release holes for ironing.

Preferably, the garment steamer further comprises a support rod which is attached to the main body and extends upward from the main body, and the support rod is used for hanging clothing or/and supporting an ironing board for laying or supporting clothing.

According to the invention, the ironing surface is provided with the blowing device, the blowing device is provided with the blowing port and the flow guiding surface, and the orientation of the blowing port deviates from the normal direction of the ironing surface, causing the airflow blown out from the blowing port when the ironing surface is close to clothing to push the clothing toward the flow guiding surface, and maintaining an airflow channel between the clothing and the flow guiding surface. During ironing, the airflow blown out from the blowing port passes between the clothing and the flow guiding surface, creating a low pressure between the clothing and the flow guiding surface. This low pressure pulls the clothing toward the flow guiding surface, ensuring that the clothing stays close to the ironing surface. Additionally, maintaining the airflow channel between the clothing and the flow guiding surface prevents the clothing from adhering to the flow guiding surface, leading to a consistent attraction effect for clothing with differences in softness and breathability, always keeping the clothing close to the ironing surface, and realizing good product versatility. Moreover, the risk of clothing damage is reduced. The blowing device provides continuous and stable airflow, and the working noise is kept at a low level without sudden increases, thus enhancing the user experience.

DESCRIPTION OF REFERENCE NUMERALS

100 steam ironing head,

110 ironing surface, 111 steam release hole, 112 edge of ironing surface, T tangential direction of ironing surface,

120 blowing device,

130 flow guiding surface,

140 head housing, 141 blowing port, 142 confluence area, 143 air inlet, 144 blowing channel, 145 air inlet channel, F direction of airflow blown out from blowing port;

150 airflow channel;

α included angle;

200 main body; 210 water tank; 220 water pump; 230 steam generator;

300 steam pipe;

400 support rod;

500 ironing board;

600 clothing.

DETAILED DESCRIPTION OF THE INVENTION

In order to make the purpose, technical scheme and advantages of the invention more clear, the technical scheme in the embodiments of the invention will be clearly and completely described below in combination with attached drawings. Obviously, the described embodiments are only part of the embodiments of the invention, not all of them. Based on the embodiments of the invention, all other embodiments obtained by those of ordinary skill in the art without making creative labor shall belong to the scope of protection of the invention.

The terms "comprise" and "have" in the specification and claims of the invention, and any variations thereof, are intended to cover non-exclusive inclusion, for example, a method or product that includes a series of technical features is not necessarily limited to those clearly listed, but may also comprise other technical features that are not clearly listed and can be included in the method or product.

In the description of the present invention, it should be understood that, orientation or positional relationships indicated by terms such as "up", "down", "front", "back", "left", and "right" are based on the orientation or positional relationships shown in the accompanying drawings, and are to facilitate the description of the present invention and simplify the description only, rather than indicating or implying that the apparatus or element referred to must have a specific orientation or be constructed and operated in a specific orientation, and therefore cannot be construed as limiting the present invention. Here, the directions of "up" and "down", "front" and "back", "left" and "right" are opposite.

The invention will be described in detail with reference to specific embodiments and attached drawings.

Figure 1:
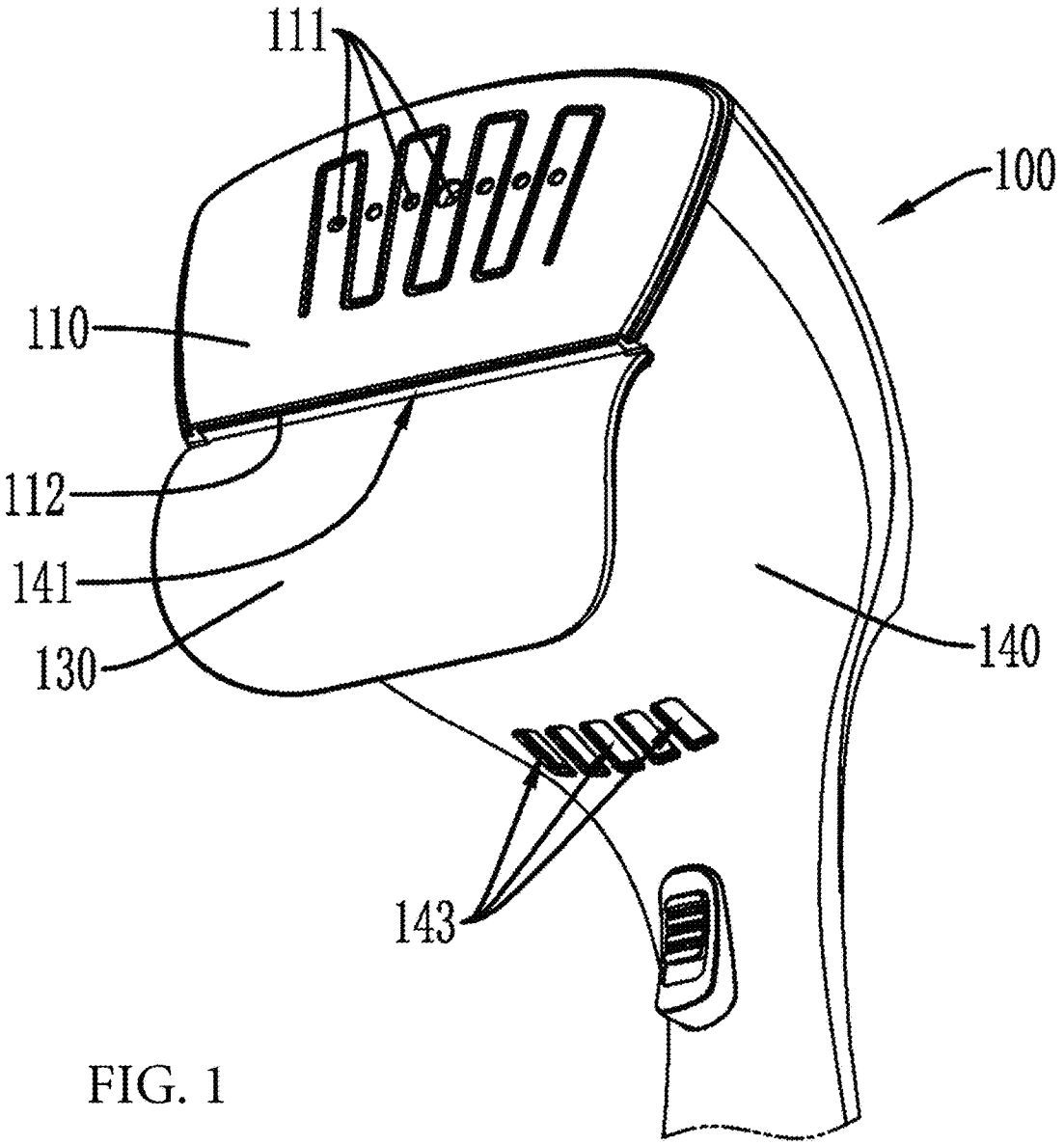
FIG. 1 is an axial view of a steam ironing head according to the invention.
Figure 2:
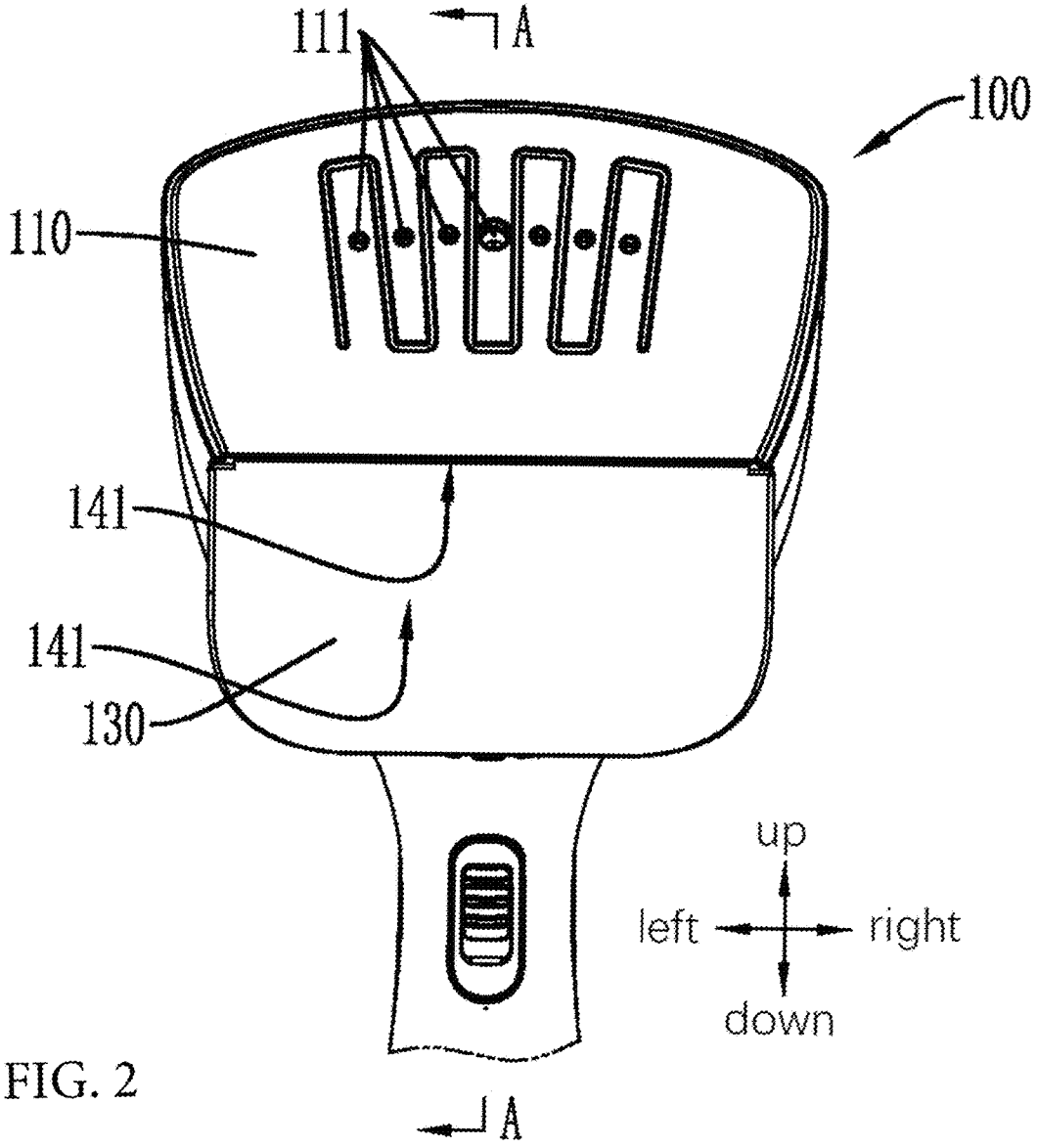
FIG. 2 is an orthographic view of the steam ironing head shown in FIG. 1 from a viewing angle.
Figure 3:
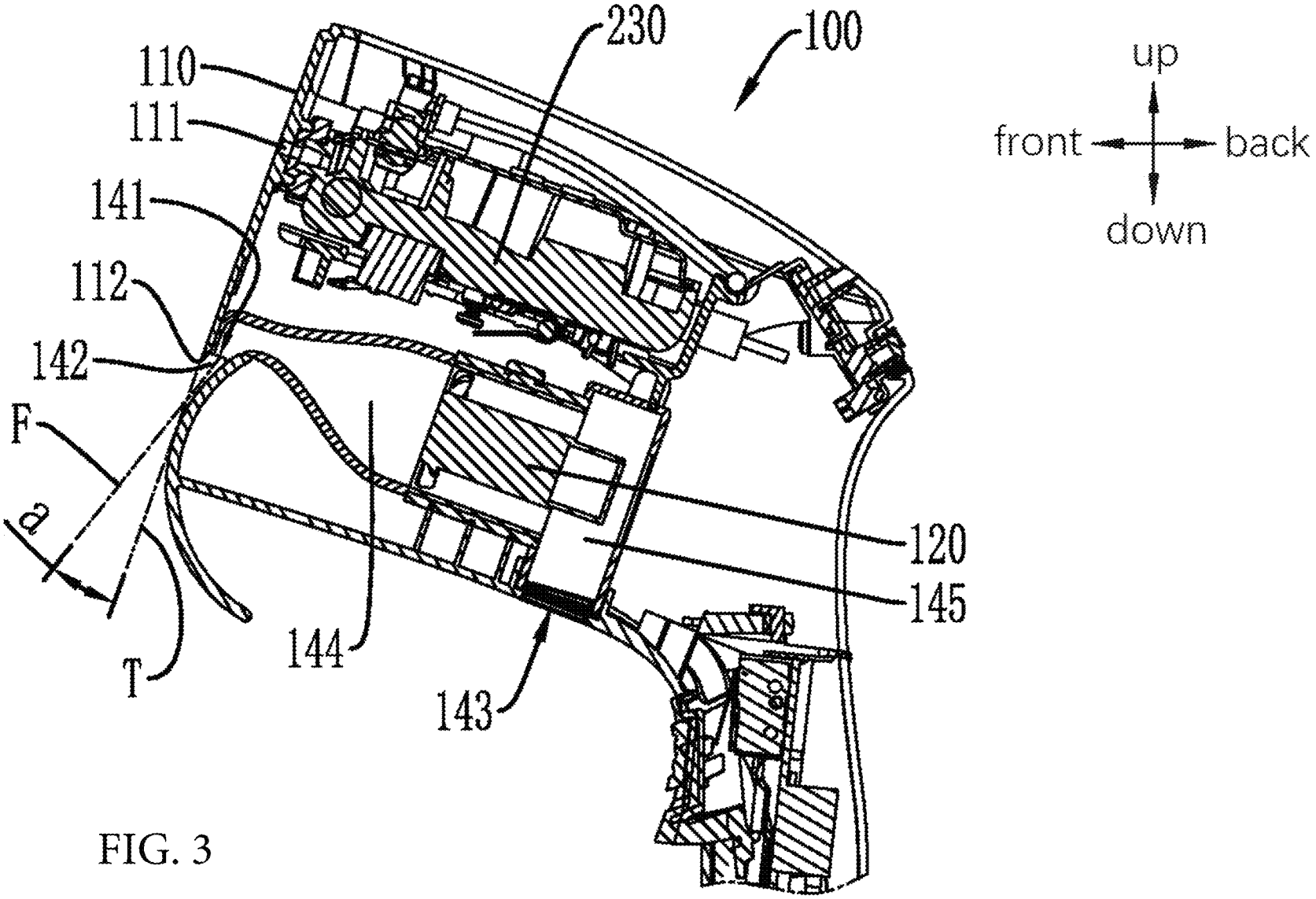
FIG. 3 is a schematic diagram of a section taken along the line A-A in FIG. 2.

As shown in FIGS. 1-3, a steam ironing head comprises a head housing 140, an ironing surface 110 with steam release holes 111, a blowing device 120 and a flow guiding surface 130. The ironing surface 110 is arranged on the head housing 140 and faces forward. The blowing device 120, such as a blower, is located in the head housing 140. A blowing channel 144 and an air inlet channel 145 are arranged in the head housing 140. The blowing device 120 is connected to a blowing port 141 through the blowing channel 144, and the blowing device 120 is connected to air inlets 143 through the air inlet channel 145. Both the blowing port 141 and the air inlets 143 are provided on an outer surface of the head housing 140. The orientation of the blowing port 141 deviates from the normal direction of the ironing surface 110. In the illustrated structure, the ironing surface 110 appears as a plane, the normal direction of the ironing surface is a direction perpendicular to the ironing surface, and the tangential direction of the ironing surface is a plane where the ironing surface is located. The flow guiding surface 130 is integrated with the head housing 140 and takes the form of a plate.

Figure 4:
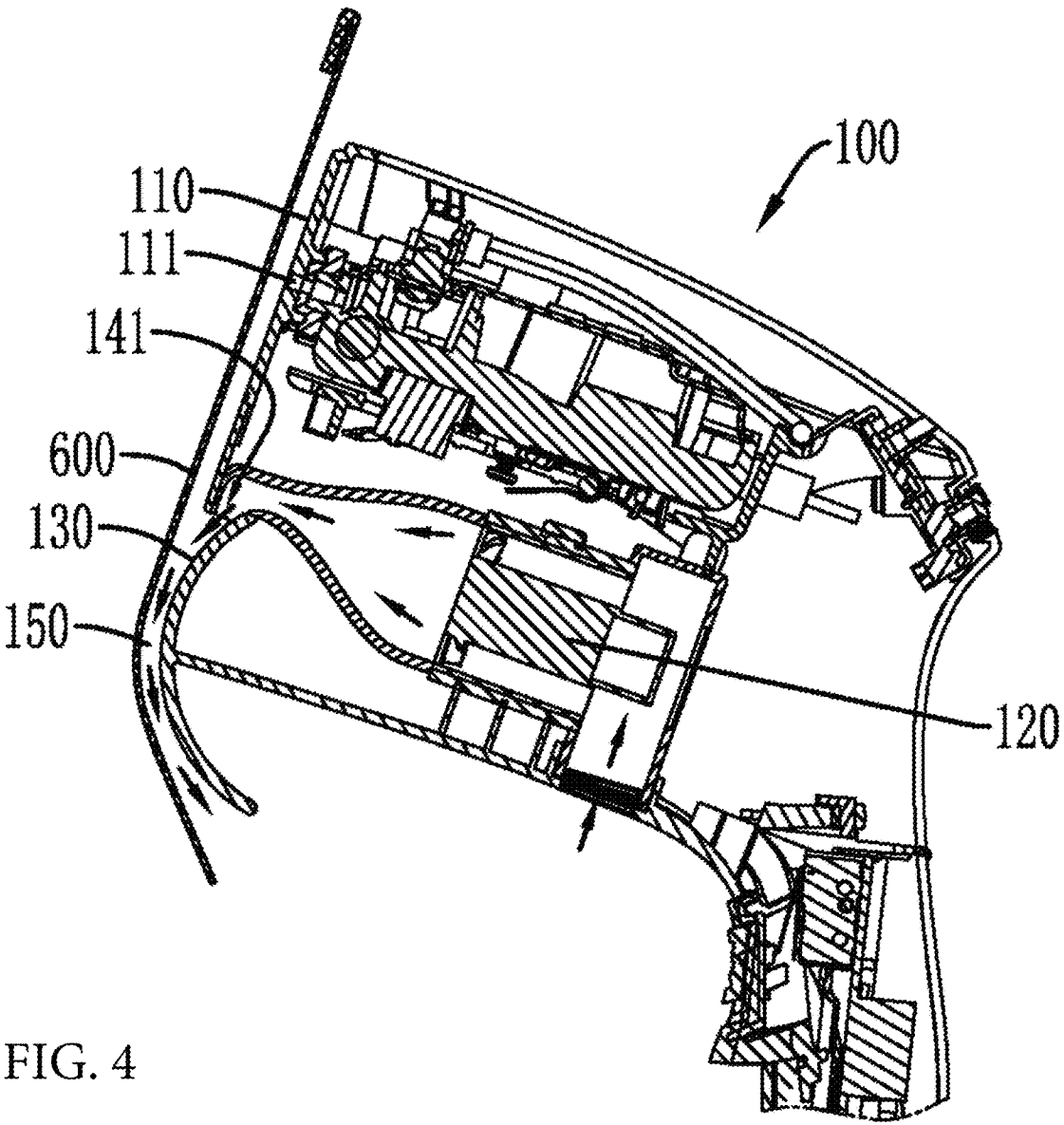
FIG. 4 is a schematic diagram of the steam ironing head shown in FIG. 3 attracting clothing.

When the steam ironing head works, as shown in FIG. 4, the ironing surface 130 is close to clothing 600 and airflow is blown from the blowing port 141 between the clothing 600 and the flow guiding surface 130. According to Bernoulli principle, the greater the fluid velocity, the smaller the pressure, and the smaller the fluid velocity, the greater the pressure. Then, because there is airflow between the clothing 600 and the flow guiding surface 130 with a faster speed than other areas, a low pressure (lower than the atmospheric pressure of the surrounding environment) is formed between the clothing 600 and the flow guiding surface 130, which pulls the clothing 600 toward the flow guiding surface 130, so that the clothing 600 can always be close to the ironing surface 110. In FIG. 4, the direction of arrows indicates the direction of airflow. Moreover, the airflow blown out from the blowing port 141 allows an airflow channel 150 to be maintained between the clothing 600 and the flow guiding surface 130, which prevents the clothing 600 from adhering to the flow guiding surface 130, leading to a consistent attraction effect for clothing with differences in softness and breathability, always keeping the clothing close to the ironing surface, and realizing good product versatility. Moreover, the risk of clothing damage is reduced during ironing. The working noise of the blowing device is kept at a low level without sudden increases, thus enhancing the user experience.

Further, an included angle a ranging from −30° to 30° is maintained between the orientation of the blowing port and the tangential direction T of the ironing surface. The included angle a is 0 when the orientation of the blowing port is consistent with the tangential direction T of the ironing surface, is positive when the orientation of the blowing port is inclined to the front side of the tangential direction T of the ironing surface, and is negative when the orientation of the blowing port is inclined to the rear side of the tangential direction T of the ironing surface. Here, the orientation of the blowing port 141 is determined by the direction F of the airflow blown out from the blowing port, and in FIG. 3, the direction of the airflow blown out from the blowing port is a line. This makes the airflow move along the surfaces of the clothing 600 and the flow guiding surface 130, ensuring that a low pressure is formed between the clothing and the flow guiding surface, so as not to blow the clothing away from the flow guiding surface and the ironing surface.

The blowing port 141 is located at a rear side of an edge 112 of the ironing surface, which is a lower edge of the ironing surface. This enables the clothing to be positioned as close to the ironing surface as possible, ensuring that the steam released from the steam release holes can be applied to the clothing at a higher temperature and a higher velocity, thus achieving a good ironing effect.

The flow guiding surface 130 is a curved surface and protrudes forward. The forward-protruding flow guiding surface features a curvature center located at a rear side of the flow guiding surface. The forward-protruding curved surface facilitates the realization of the "Coanda effect" which is also known as wall attachment effect.

The Coanda effect manifests as: flow (water or air flow) deviates from its original direction and instead tends to move along a protruding surface. When there is surface friction (also known as fluid viscosity) between the flow and the surface it flows over, as long as the curvature is not significant, the flow will follow the surface. The decrease in flow velocity and change in direction of movement (curved streamlines) result in the external pressure of the flow (atmospheric pressure) being greater than the pressure at the interior and at the boundary with the curved surface, causing the flow to move while adhering to the curved surface.

According to the invention, the airflow blown out from the blowing port 141 flows between the flow guiding surface 130 and the clothing 600, and the flow guiding surface 130 protruding forward acts as the protruding surface in the Coanda effect. The air pressure between the flow guiding surface 130 and the clothing 600 is smaller than that outside the flow guiding surface and the clothing, so that the clothing 600 is pulled toward the flow guiding surface, and the clothing is brought as close as possible to the ironing surface, ensuring that the steam released from the steam release holes can be applied to the clothing at a higher temperature and a higher velocity, thus achieving a good ironing effect.

The flow guiding surface 130 extends from a rear edge of the blowing port 141 in a direction away from an air outlet, as shown in the figures, extending downward. This gives the flow guiding surface an appropriate length and area so that when the ironing surface is brought close to the clothing, a low pressure can be quickly formed between the clothing and the flow guiding surface, achieving the attraction effect.

A confluence area 142 is formed at an outlet of the blowing port 141 between the flow guiding surface 130 and the tangential direction T of the ironing surface, and the confluence area 142 gradually decreases as it extends away from the blowing port 141. This can increase the airflow speed, effectively pulling the clothing toward the flow guiding surface.

The flow guiding surface 130 is entirely located at a rear side of the tangential direction T of the ironing surface. This enables the clothing to be positioned as close to the ironing surface as possible, ensuring that the steam released from the steam release holes can be applied to the clothing at a higher temperature and a higher velocity, thus achieving a good ironing effect. In addition, when users lay clothing flat on an ironing board for ironing, it ensures that the ironing surface makes contact with the clothing.

The blowing port 141 and the flow guiding surface 130 are located at a lower side of the ironing surface 110. This facilitates user operations. For example, when ironing clothing which is in a hung state, the ironing surface is moved downward along the surface of the clothing, and by means of the pulling force of hangers and the low pressure generated by airflow which attracts the clothing toward the ironing surface, the part of the clothing corresponding to the ironing surface can maintain tension and flatten, which is conducive to the application of released steam onto the clothing, resulting in a good ironing effect.

The blowing device is provided with air inlets 143, and the blowing device 120 is connected with the air inlets 143 through an air inlet channel 145. The air inlets 143 are located under the head housing 140, and the air inlets 143 are also located behind the flow guiding surface 130, thus avoiding the blowing port 141 and the flow guiding surface 130. This can maintain the stable operation of the blowing device, resulting in minimal noise, and also prevent the low pressure formed by the airflow from becoming unstable or weakening due to the air inlets being positioned too close to the blowing port and the flow guiding surface.

The blowing device operates using power from a power cord or from a storage battery. This provides a variety of implementation schemes for the product structure.

The blowing port 141 is slit-shaped and extends in a length direction of one straight edge of the ironing surface. In the diagram, the straight edge corresponds to a lower edge of the ironing surface indicated by 112. This ensures consistent blowing intensity at various parts of the blowing port, so that when moving in a direction perpendicular to the straight edge of the ironing surface, all parts of the blowing port achieve a consistent attraction effect on the clothing.

To realize a better fit between the ironing surface and the clothing, the widths of the blowing port 141, the flow guiding surface 130 and the ironing surface 110 tend to be consistent. The width corresponds to the left-right direction in FIG. 2. In this way, clothing can be attracted within the whole width range of the ironing surface, and the whole area of the ironing surface can be used to iron clothing.

In other embodiments, the ironing surface is arranged on the head housing, and the blowing device 120 or/and the flow guiding surface 130 are detachably attached to the head housing. When the attraction function is not needed, for example, when the user irons clothing laid flat on the ironing board, the blowing device or/and the flow guiding surface can be detached from the head housing, thus reducing the holding burden of the user during ironing.

Figure 5:
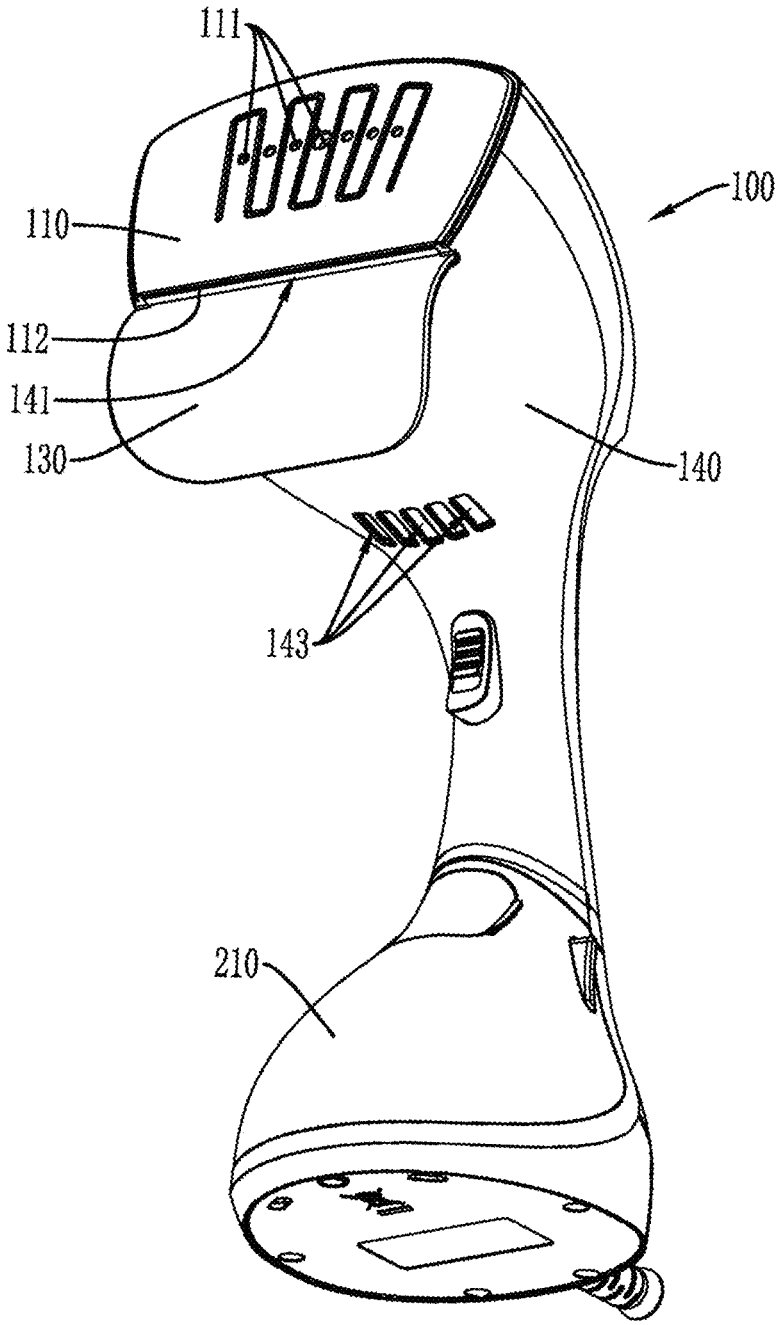
FIG. 5 is a schematic diagram of a steam ironing head of the invention being applied to a hand-held ironing machine.
Figure 6:
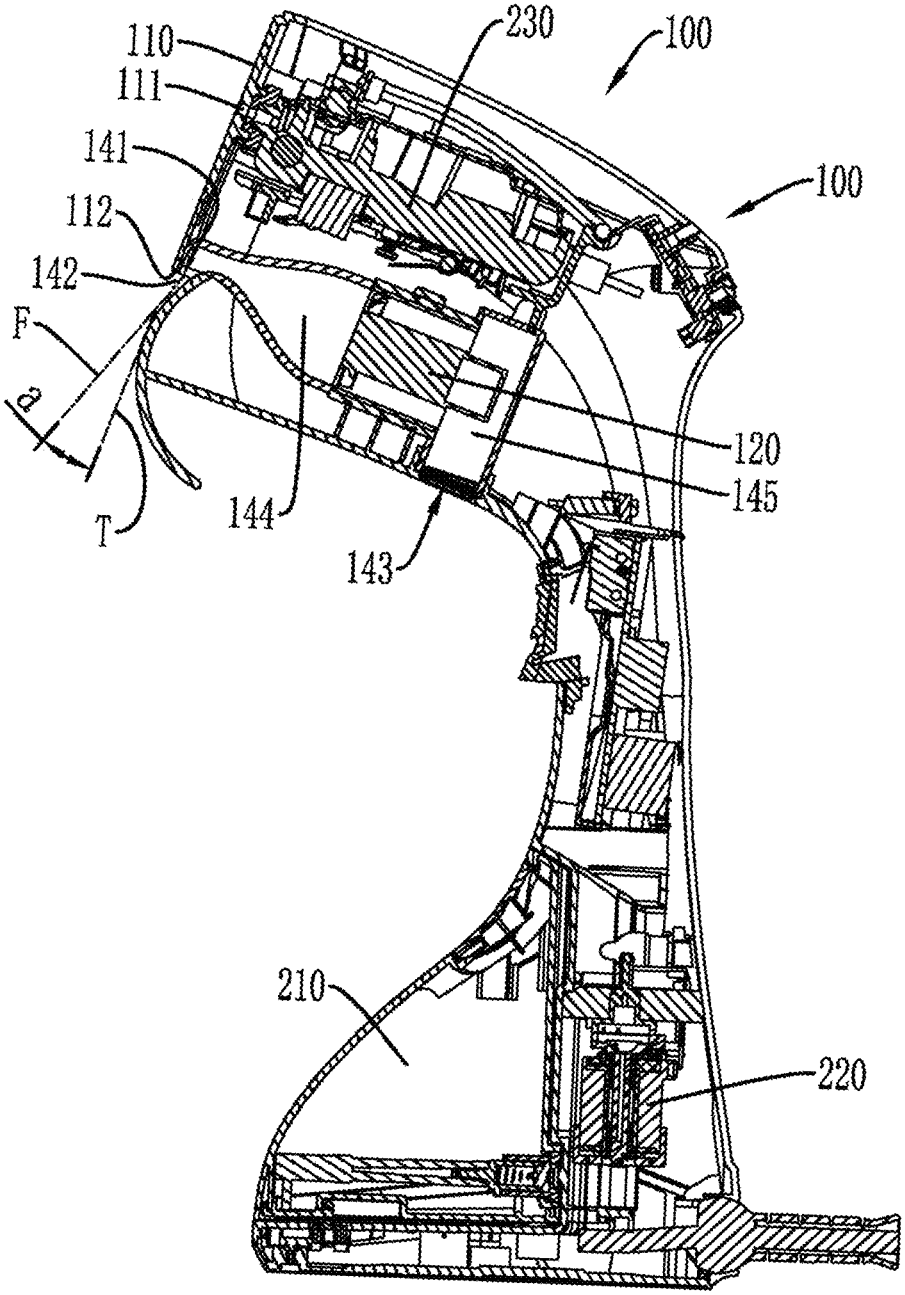
FIG. 6 is a schematic diagram of a sectional structure of FIG. 5.

FIGS. 5-6 are schematic diagrams of a steam ironing head 100 of the invention being applied to a hand-held ironing machine. The hand-held ironing machine comprises a water tank 210, a water pump 220 and a steam generator 230, the water pump is used for conveying water stored in the water tank to the steam generator, and the steam generator is used for vaporizing the conveyed water into steam. The steam generated by the steam generator is released from the steam release holes 111 of the steam ironing head 100. The steam ironing head 100, the water tank 210, the water pump 220 and the steam generator 230 are assembled into a whole for holding and ironing. In this way, one can hold the hand-held ironing machine to steam or iron clothing.

Figure 7:
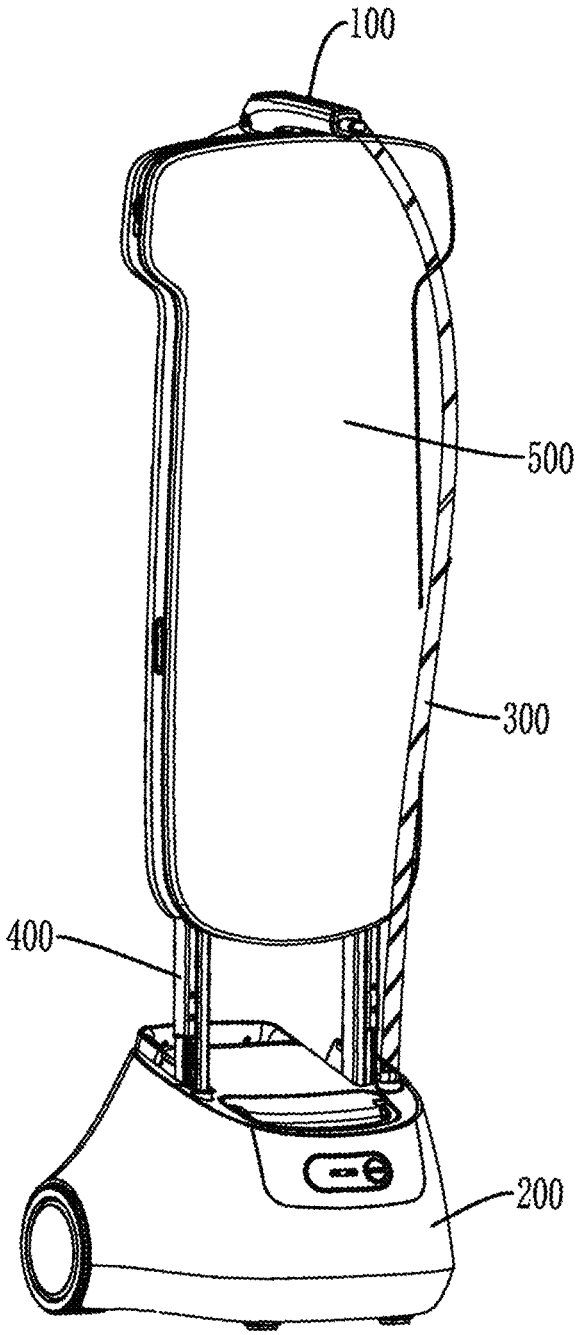
FIG. 7 is a schematic diagram of a steam ironing head of the invention being applied to a garment steamer.

FIG. 7 is a schematic diagram of a steam ironing head 100 of the invention being applied to a garment steamer. The garment steamer comprises a main body 200 equipped with a water tank, a water pump and a steam generator, the water pump is used for conveying water stored in the water tank to the steam generator, and the steam generator is used for vaporizing the conveyed water into steam. The steam ironing head 100 is connected with the steam generator on the main body through a steam pipe 300, and the steam generated by the steam generator is conveyed to the steam ironing head through the steam pipe 300 and released from the steam release holes 111 for ironing. In this way, one can hold the steam ironing head 100 for ironing. Further, the garment steamer may further comprise a support rod 400 which is attached to the main body 200 and extends upward from the main body, and the support rod is used for hanging clothing or/and supporting an ironing board 500 for laying or supporting clothing. In this way, one can steam hanging clothing or iron clothing placed flat on the ironing board.

When steaming hanging clothing, the blowing device can be activated to pull the clothing closer to the ironing surface. When ironing clothing placed flat on the ironing board, one can disable the blowing device so that the clothing is not attracted, and iron the clothing by relying on contact with the ironing surface.

What is claimed is:

1. A steam ironing head, comprising an ironing surface with steam release holes, a blowing device and a flow guiding surface, wherein the blowing device is connected with a blowing port, and the orientation of the blowing port deviates from the normal direction of the ironing surface, causing the airflow blown out from the blowing port when the ironing surface is close to clothing to push the clothing toward the flow guiding surface, and maintaining an airflow channel between the clothing and the flow guiding surface;

wherein a confluence area is formed at an outlet of the blowing port between the flow guiding surface and the tangential direction of the ironing surface, and the confluence area gradually decreases as it extends away from the blowing port;

the flow guiding surface is a curved surface and protrudes forward, when the airflow blown out from the blowing port flows between the flow guiding surface and the clothing, the air pressure between the flow guiding surface and the clothing is smaller than that outside the flow guiding surface and the clothing, so that the clothing is pulled toward the flow guiding surface, and the clothing is brought as close as possible to the ironing surface; and the blowing port and the flow guiding surface are located at a lower side of the ironing surface, when ironing clothing which is in a hung state, the ironing surface is moved downward along the surface of the clothing, the part of the clothing corresponding to the ironing surface can maintain tension and flatten.

2. The steam ironing head according to claim 1, wherein an included angle (a) ranging from −30° to 30° is maintained between the orientation of the blowing port and the tangential direction of the ironing surface.

3. The steam ironing head according to claim 1, wherein the blowing port is located at a rear side of an edge of the ironing surface.

4. The steam ironing head according to claim 1, wherein the flow guiding surface extends from a rear edge of the blowing port in a direction away from an air outlet.

5. The steam ironing head according to claim 1, wherein the flow guiding surface is entirely located at a rear side of the tangential direction of the ironing surface.

6. The steam ironing head according to claim 1, wherein the blowing device is equipped with air inlets, and the air inlets avoid the blowing port and the flow guiding surface.

7. The steam ironing head according to claim 1, wherein the blowing device operates using power from a power cord or from a storage battery.

8. The steam ironing head according to claim 1, wherein the ironing surface is arranged on a head housing, and the blowing device is configured in any of the following ways:

(1) the blowing device is located in the head housing, and a blowing channel connecting the blowing port with the blowing device is arranged inside the head housing; and (2) the blowing device or/and the flow guiding surface are detachably attached to the head housing.

9. The steam ironing head according to claim 1, wherein the blowing port is slit-shaped and extends in a length direction of one straight edge of the ironing surface; or/and the widths of the blowing port, the flow guiding surface and the ironing surface tend to be consistent.

10. A hand-held ironing machine, comprising a water tank, a water pump and a steam generator, the water pump being used for conveying water stored in the water tank to the steam generator, and the steam generator being used for vaporizing the conveyed water into steam; further comprising a steam ironing head, the steam ironing head comprising an ironing surface with steam release holes, a blowing device and a flow guiding surface, wherein the blowing device is connected with a blowing port, and the orientation of the blowing port deviates from the normal direction of the ironing surface, causing the airflow blown out from the blowing port when the ironing surface is close to clothing to push the clothing toward the flow guiding surface, and maintaining an airflow channel between the clothing and the flow guiding surface, wherein the steam generated by the steam generator is released from the steam release holes, and the steam ironing head, the water tank, the water pump and the steam generator are assembled into a whole for holding and ironing, wherein a confluence area is formed at an outlet of the blowing port between the flow guiding surface and the tangential direction of the ironing surface, and the confluence area gradually decreases as it extends away from the blowing port;

the flow guiding surface is a curved surface and protrudes forward, when the airflow blown out from the blowing port flows between the flow guiding surface and the clothing, the air pressure between the flow guiding surface and the clothing is smaller than that outside the flow guiding surface and the clothing, so that the clothing is pulled toward the flow guiding surface, and the clothing is brought as close as possible to the ironing surface; and the blowing port and the flow guiding surface are located at a lower side of the ironing surface, when ironing clothing which is in a hung state, the ironing surface is moved downward along the surface of the clothing, the part of the clothing corresponding to the ironing surface can maintain tension and flatten.

11. A garment steamer, comprising a main body equipped with a water tank, a water pump and a steam generator, the water pump being used for conveying water stored in the water tank to the steam generator, and the steam generator being used for vaporizing the conveyed water into steam; further comprising a steam ironing head, the steam ironing head comprising an ironing surface with steam release holes, a blowing device and a flow guiding surface, wherein the blowing device is connected with a blowing port, and the orientation of the blowing port deviates from the normal direction of the ironing surface, causing the airflow blown out from the blowing port when the ironing surface is close to clothing to push the clothing toward the flow guiding surface, and maintaining an airflow channel between the clothing and the flow guiding surface, wherein the steam ironing head is connected with the steam generator through a steam pipe, and the steam generated by the steam generator is conveyed to the steam ironing head through the steam pipe and released from the steam release holes for ironing, wherein a confluence area is formed at an outlet of the blowing port between the flow guiding surface and the tangential direction of the ironing surface, and the confluence area gradually decreases as it extends away from the blowing port;

the flow guiding surface is a curved surface and protrudes forward, when the airflow blown out from the blowing port flows between the flow guiding surface and the clothing, the air pressure between the flow guiding surface and the clothing is smaller than that outside the flow guiding surface and the clothing, so that the clothing is pulled toward the flow guiding surface, and the clothing is brought as close as possible to the ironing surface; and the blowing port and the flow guiding surface are located at a lower side of the ironing surface, when ironing clothing which is in a hung state, the ironing surface is moved downward along the surface of the clothing, the part of the clothing corresponding to the ironing surface can maintain tension and flatten.

12. The garment steamer according to claim 11, wherein the garment steamer further comprises a support rod which is attached to the main body and extends upward from the main body, and the support rod is used for hanging clothing or/and supporting an ironing board for laying or supporting clothing.

* * * * *